US007684729B2

(12) United States Patent
Goda

(10) Patent No.: US 7,684,729 B2
(45) Date of Patent: Mar. 23, 2010

(54) IMAGE-FORMING MACHINE

(75) Inventor: Mitsuhiro Goda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 520 days.

(21) Appl. No.: 11/657,565

(22) Filed: Jan. 25, 2007

(65) Prior Publication Data

US 2007/0177893 A1 Aug. 2, 2007

(30) Foreign Application Priority Data

Jan. 27, 2006 (JP) ..... 2006-018488

(51) Int. Cl.
*G03G 21/18* (2006.01)

(52) U.S. Cl. ..... 399/114; 399/110

(58) Field of Classification Search ..... 399/110, 399/111, 114
See application file for complete search history.

(56) References Cited

U.S. PATENT DOCUMENTS 4,462,677 A * 7/1984 Onoda ..... 399/114
6,163,666 A * 12/2000 Hosokawa et al. ..... 399/111
2005/0147430 A1* 7/2005 Carter et al. ..... 399/113
2005/0191089 A1* 9/2005 Nishimura ..... 399/111

FOREIGN PATENT DOCUMENTS

JP 2004-151568 5/2004

* cited by examiner

*Primary Examiner*—David P Porta
*Assistant Examiner*—Benjamin Schmitt
(74) *Attorney, Agent, or Firm*—Smith, Gambrell & Russell, LLP

(57) ABSTRACT

An image-forming machine includes a photosensitive material drum, a developer mounted on a machine body so as to move in a direction to approach, and separate away from, the photosensitive material drum along guide means arranged in the machine body, and a protection cover that opens and closes a portion of the peripheral surface of the photosensitive material drum. The protection cover is supported by the machine body so as to rotate between a closed position and an opened position. An arm member is rotatably arranged in the machine body being drive-coupled to the protection cover so as to open and close the protection cover. An end of the arm member is so positioned as to be present on a locus of motion of the developer.

8 Claims, 14 Drawing Sheets

IMAGE-FORMING MACHINE

BACKGROUND OF THE INVENTION

1. Field of the Invention

The present invention relates to an image-forming machine of the type of electrostatic photography, such as a laser printer, a copier or a facsimile and, particularly, to an image-forming machine of the type of electrostatic photography equipped with a protection cover capable of opening and closing the exposing surface of a photosensitive material drum.

2. Description of the Related Art

In an image-forming machine, in general, a drum unit that includes a photosensitive material drum or a process unit that includes the drum unit and a developer, is equipped with a protection cover for opening and closing the exposing surface of the photosensitive material drum. JP-A-2004-151568 is disclosing an image-forming machine in which the drum unit in the process unit is equipped with a protection cover. In this machine, the drum unit includes an arm member that is rotatably arranged to open and close the protection cover, and a torsion coil spring provided between the drum unit and the arm portion so as to urge the arm member at all times toward the closed position where the protection cover conceals the exposing surface of the photosensitive material drum. When the process unit is mounted on the machine body, the arm member interferes with a stationary portion of the machine body and is rotated against the spring force of the torsion coil spring, causing the protection cover to open so that the exposing surface is exposed. When the process unit is removed from the machine body, on the other hand, the arm member is liberated from the interference with the stationary portion of the machine body, and is rotated up to the closed position due to the spring force of the torsion coil spring, causing the exposing surface to be concealed.

If the jamming occurs while the image-forming machine is in operation, the process unit is removed from the machine body to remove the jamming. After the jamming has been removed, the process unit is mounted on the machine body. The process unit is also removed and is, then, mounted at the time of regular maintenance. The protection cover temporarily coneals the exposing surface of the photosensitive material drum at the time of the above removal and mounting in order to protect the surface from being damaged.

When the drum unit or the process unit is to be replaced in the image-forming machine in which the protection cover is provided for the process unit including the drum unit or in the image-forming machine in which the protection cover is provided for the drum unit that is independently and detachably attached to the machine body, it is forced to exchange the protection cover and the related members together with the drum unit or the process unit though they really do not have to be renewed, accounting for the waste of materials and driving up the cost. Besides, the disposal of parts in an increased amount is not desirable even from the standpoint of protecting the environment.

SUMMARY OF THE INVENTION

It is, therefore, an object of the present invention to provide a novel image-forming machine which prevents an increase in the cost that stems from the wasteful replacement of the parts and, at the same time, contributes to protecting the environment.

According to the present invention, there is provided an image-forming machine comprising a photosensitive material drum rotatably arranged in a machine body, a developer mounted on the machine body so as to move in a direction to approach, and separate away from, the photosensitive material drum along guide means arranged in the machine body, and a protection cover that opens and closes a portion of the peripheral surface of the photosensitive material drum; wherein the protection cover is supported by the machine body so as to rotate between a closed position and an opened position, an arm member is rotatably arranged in the machine body being drive-coupled to the protection cover so as to open and close the protection cover, and an end of the arm member is so positioned as to be present on a locus of motion of the developer; and when the developer is moved in a direction to approach the photosensitive material drum along the guide means of the machine body, the one end of the arm member is rotated by the developer in one rotational direction, and the protection cover rotates in a direction in which it opens from the closed position up to the opened position.

It is desired that:

the machine body includes a pair of side walls arranged maintaining a distance relative to each other;

the protection cover includes a cover body extending in the lengthwise direction which is in agreement with the axial direction of the photosensitive material drum, first shaft means disposed at an end of the cover body in the lengthwise direction thereof, and second shaft means disposed at the other end of the cover body in the lengthwise direction thereof on an axis in common with the first shaft means;

the first shaft means of the protection cover is rotatably supported by the one side wall, and the second shaft means is rotatably supported by the other side wall;

the arm member is rotatably supported by the one side wall and is drive-coupled to the first shaft means of the protection cover;

the photosensitive material drum is arranged between the pair of side walls; and a stop wall is arranged at a position over the photosensitive material drum between the pair of side walls to define a position at where the protection cover opens by blocking the rotation of the protection cover in the direction in which it opens.

It is desired that provision is made of first spring means which urges the protection cover at all times so as to be rotated in a direction in which it closes, and stop means which brings the protection cover to the closed position by blocking the rotation of the protection cover in the direction in which it closes, and the one end of the arm member is rotated by the developer in the one rotational direction overcoming the spring force of the first spring means.

It is desired that the first spring means comprises a torsion coil spring disposed between the arm member and the one side wall, and the stop means comprises a stopper disposed on the one side wall so as to block the rotation of the arm member in the other rotational direction.

It is desired that:

provision is made of second spring means for urging the protection cover in the axial direction of the first and second shaft means toward the one side wall;

the first shaft means of the protection cover includes a body-end shaft formed integrally with the cover body and is extending in the axial direction from an end of the cover body, and a separable driven shaft fitted to the one body-end shaft, supported by the one side wall so as to rotate but being blocked from moving in the axial direction toward the one side wall, and is drive-coupled to an arm member;

the second shaft means of the protection cover comprises the other body-end shaft formed integrally with the cover body and is extending in the axial direction from the other end of the cover body, the other body-end shaft being supported by the other side wall so as to rotate and to move in the axial direction;

the one body-end shaft of the first shaft means and the separable driven shaft are, respectively, provided with first press-contact surfaces which are brought into press-contact with each other in the circumferential direction to rotate the one body-end shaft integrally therewith when the separable driven shaft is rotated in a direction in which the protection cover closes and are, further, provided with second press-contact surfaces which are brought into press-contact with each other by the spring force of the second spring means in the axial direction to rotate the one body-end shaft integrally therewith when the separable driven shaft is rotated in a direction in which the protection cover opens, and are allowed to move relative to each other in the axial direction; and the one body-end shaft moves in the axial direction toward the other side wall when the separable driven shat is rotated in the direction in which the protection cover opens in a state where the protection cover is at the opened position.

It is desired that the second spring means comprises a compression coil spring disposed between the other side wall and the protection cover.

It is desired that:

the one body-end shaft in the first shaft means of the protection cover includes the one first press-contact surface comprising the first end surface extending in the axial direction and facing in one circumferential direction, and a second end surface extending in the circumferential direction and in the axial direction from the proximal end of the one first press-contact surface and arriving at an end of the one first press-contact surface, the second end surface including the one second press-contact surface comprising a helical surface that is helically extending; and the separable driven shaft in the first shaft means of the protection cover includes the other first press-contact surface opposed in the circumferential direction to the one first press-contact surface of the one body-end shaft, and the other second press-contact surface comprising a helical surface opposed to at least a portion of the region of the one second press-contact surface of the one body-end shaft.

It is desired that a driven gear is attached to the separable driven shaft in the first shaft means of the protection cover so as to rotate integrally therewith, a drive gear is attached to the arm member integrally therewith, and the drive gear of the arm member and the driven gear of the separable driven shaft are drive-coupled together via at least one intermediate gear rotatably supported by the one side surface.

DESCRIPTION OF THE PREFERRED EMBODIMENTS

Embodiments of the image-forming machine constituted according to the present invention will now be described in detail with reference to the accompanying drawings.

Figure 1:
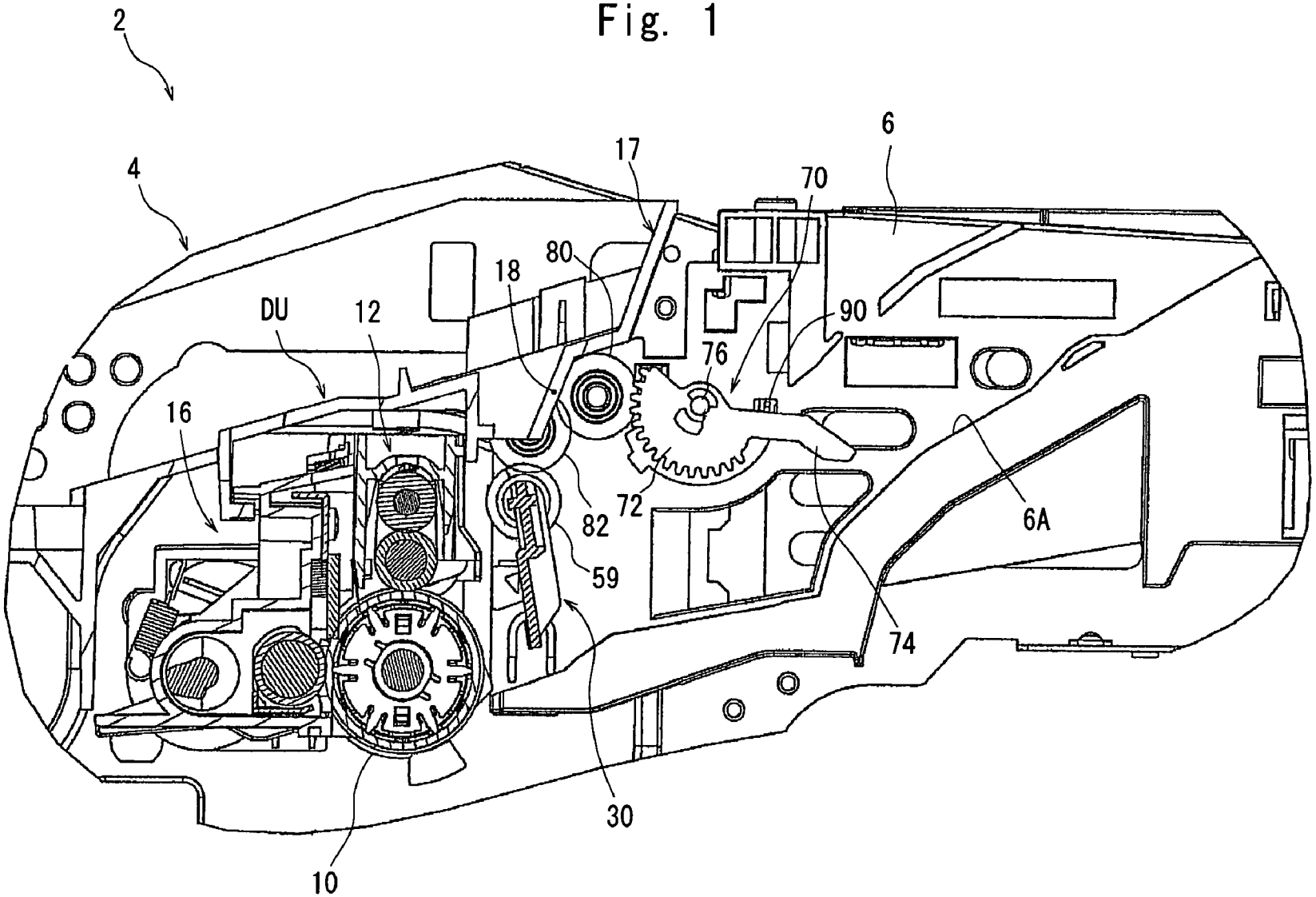
FIG. 1 is a sectional view illustrating major portions of an embodiment of an image-forming machine constituted according to the present invention.
Figure 3:
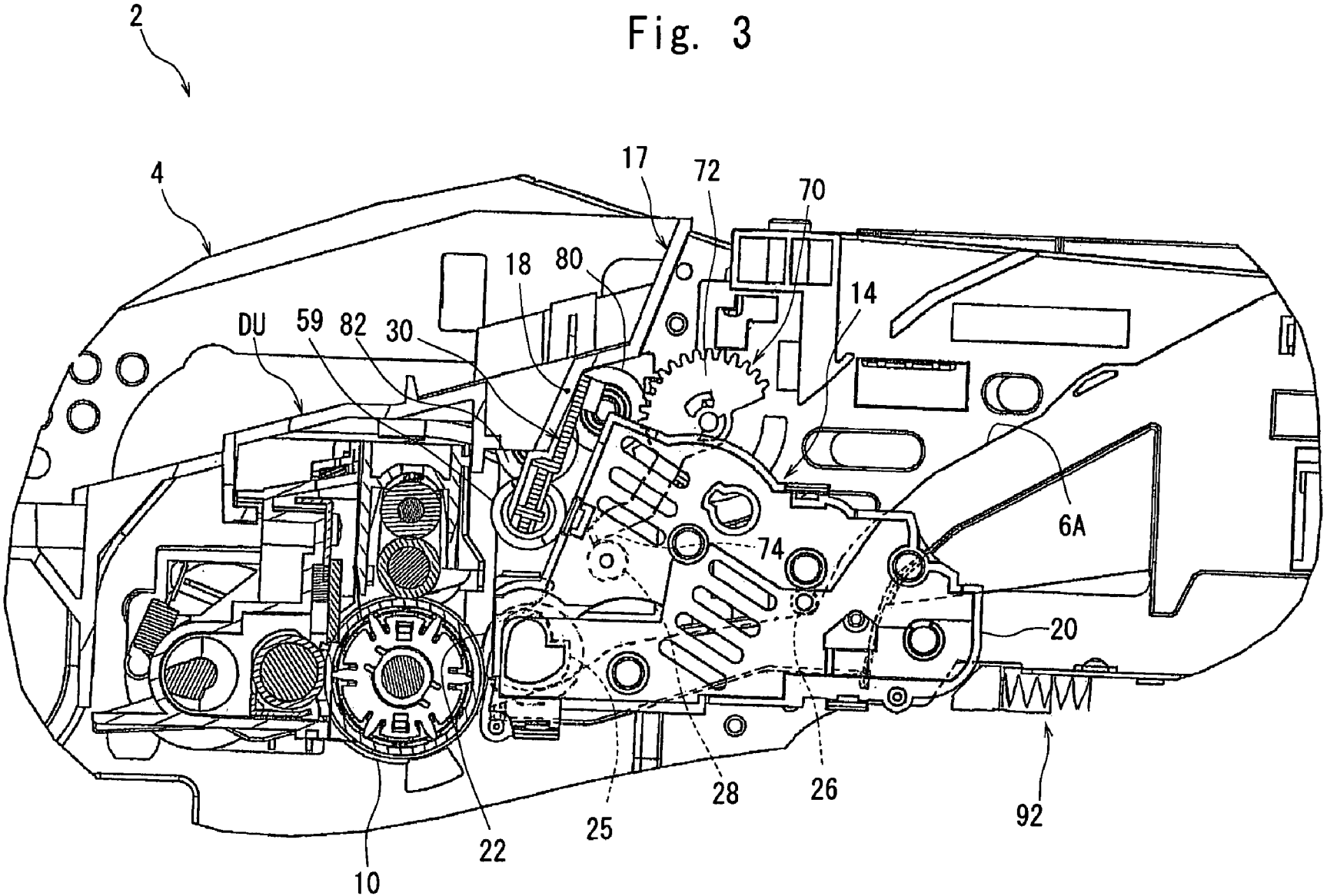
FIG. 3 is a sectional view illustrating a further mode of operation of the image-forming machine shown in FIG. 1.
Figure 4:
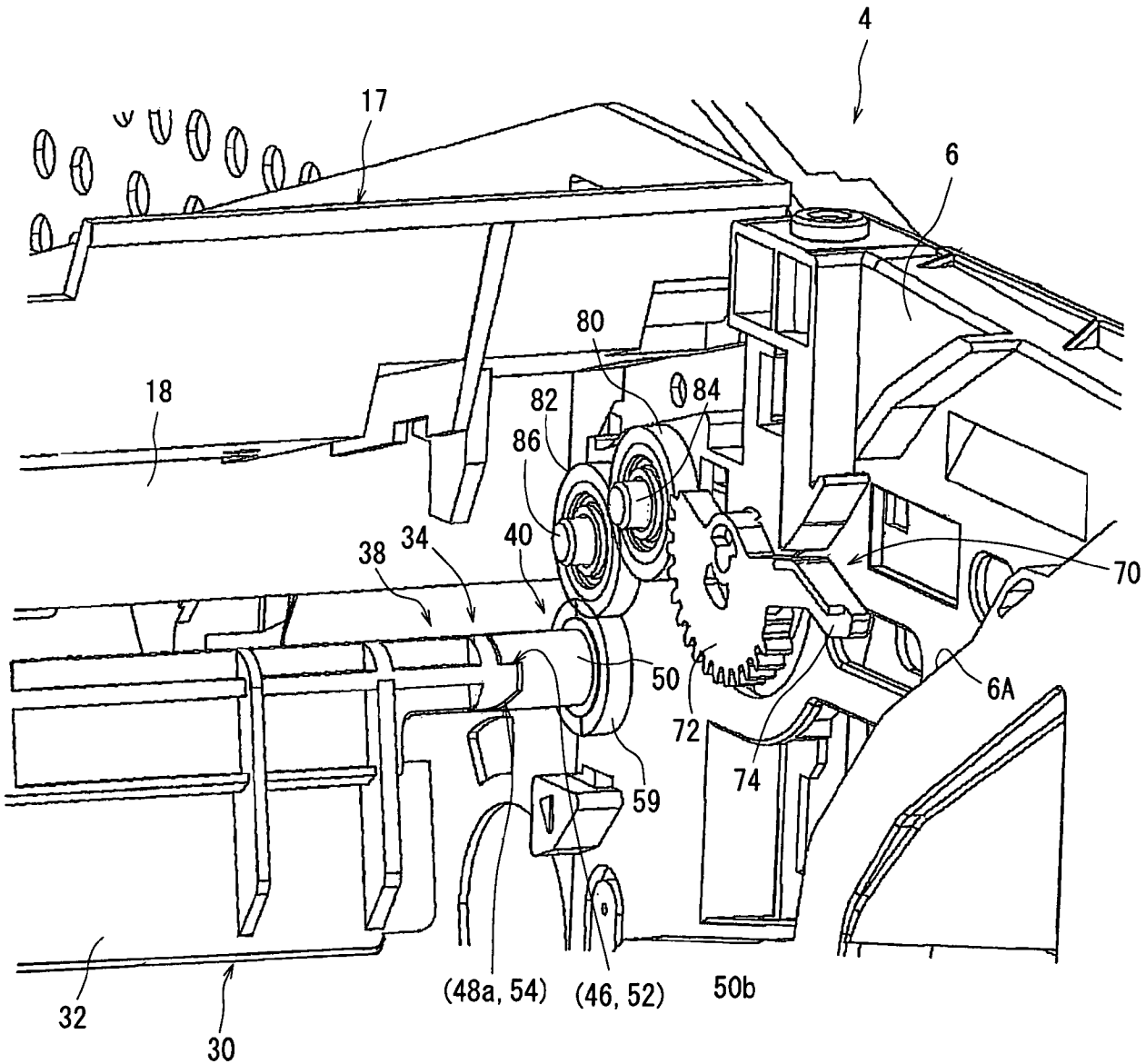
FIG. 4 is a perspective view illustrating, on an enlarged scale, a portion of the image-forming machine shown in FIG. 1.
Figure 5:
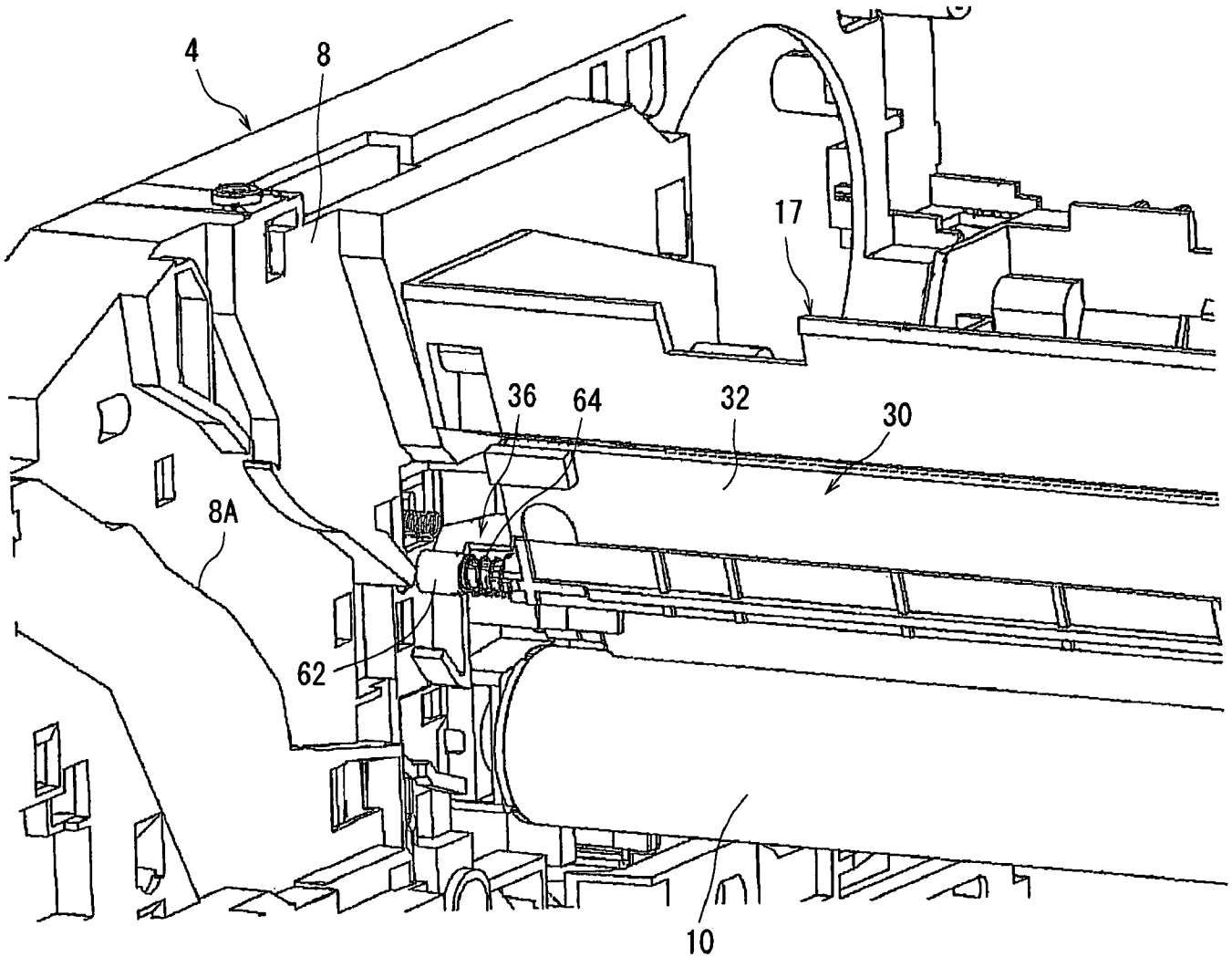
FIG. 5 is a perspective view illustrating another portion of the image-forming machine shown in FIG. 2 (another portion relative to FIG. 4)

Referring to FIGS. 1, 4 and 5, an image-forming machine 2 which is only partly shown has a machine body 4 that includes a pair of side walls 6 and 8 arranged maintaining a distance relative to each other. A drum unit DU is detachably mounted between the side walls 6 and 8. The drum unit DU supports a photosensitive material drum 10 so that it rotates. The photosensitive material drum 10 in the drum unit DU is surrounded by charging means 12, transfer means (not shown), a cleaning unit 16 and charge-removing means (not shown). A developer 14 (FIGS. 2 and 3) that will be described later is detachably mounted on the machine body 4. Exposing means (e.g., laser scanning unit) that is not shown is disposed over the drum unit DU between the side walls 6 and 8. A coupling wall 17 is arranged at a position over the photosensitive material drum 10 between the side walls 6 and 8, which is nearly a right upper position relative to the drum unit DU in FIG. 1, the coupling wall 17 extending between the side walls 6 and 8, and coupling the side walls 6 and 8 together. The lower end region of the coupling wall 17 is tilted toward the photosensitive material drum 10 from the upper side to the lower side. The tilted lower end region constitutes a stop wall 18 which prevents a protection cover 30 that will be described later from rotating in the direction in which it opens from the closed position, and defines a position at where the protection cover opens 30.

On the insides of the side walls 6 and 8 opposed to each other, guide surfaces 6A and 8A of substantially the same shape are arranged at substantially the same positions opposed to each other. The guide surface 6A protrudes inward from the side wall 6 nearly horizontally by only a predetermined width, and is arranged to extend downward from the right upper side toward the left (in a direction to substantially approach the photosensitive material drum 10) (see also FIGS. 6 and 7). The guide surface 8A (FIG. 5) protrudes inward from the side wall 8 nearly horizontally by only a predetermined width, and is arranged to extend at a position corresponding to the guide surface 6A in the horizontal direction. If viewed in the axial direction of the photosensitive material drum 10, the ends of the guide surfaces 6A and 8A are present near the right side of the lower region of the outer circumferential surface of the photosensitive material drum 10 in FIG. 1. The guide surfaces 6A and 8A constitute guide means of the developer 14 that will be described later.

Figure 2:
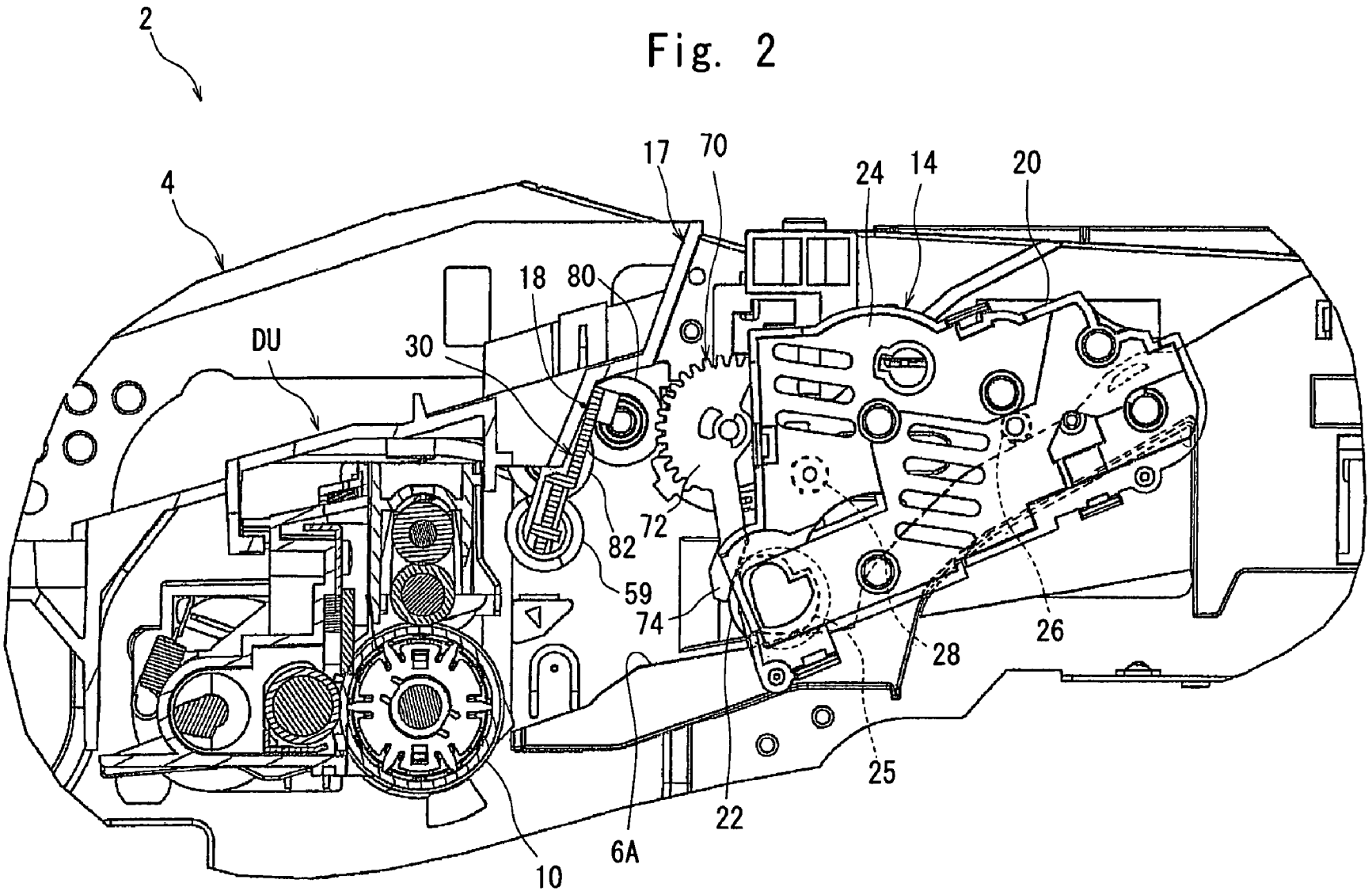
FIG. 2 is a sectional view illustrating another mode of operation of the image-forming machine shown in FIG. 1.

Referring to FIG. 2, the developer 14 has a housing 20 for containing the toner. A developer sleeve that is not shown is provided at a left end of the housing 20 in FIG. 2, and gap-setting rollers 22 (FIG. 2 shows one gap-setting roller 22 only) are disposed at both ends of the developer sleeve in the axial direction thereof (direction perpendicular to the surface of the paper in FIG. 2), the gap-setting rollers 22 having a diameter slightly larger than that of the developer sleeve and in concentric with the developer sleeve. The gap-setting rollers 22 are in contact with both ends on the surface of the photosensitive material drum 10, define a predetermined gap between the surface of the photosensitive material drum 10 and the surface of the developer sleeve, and define the position for mounting the developer 14 on the machine body 4.

Figure 12:
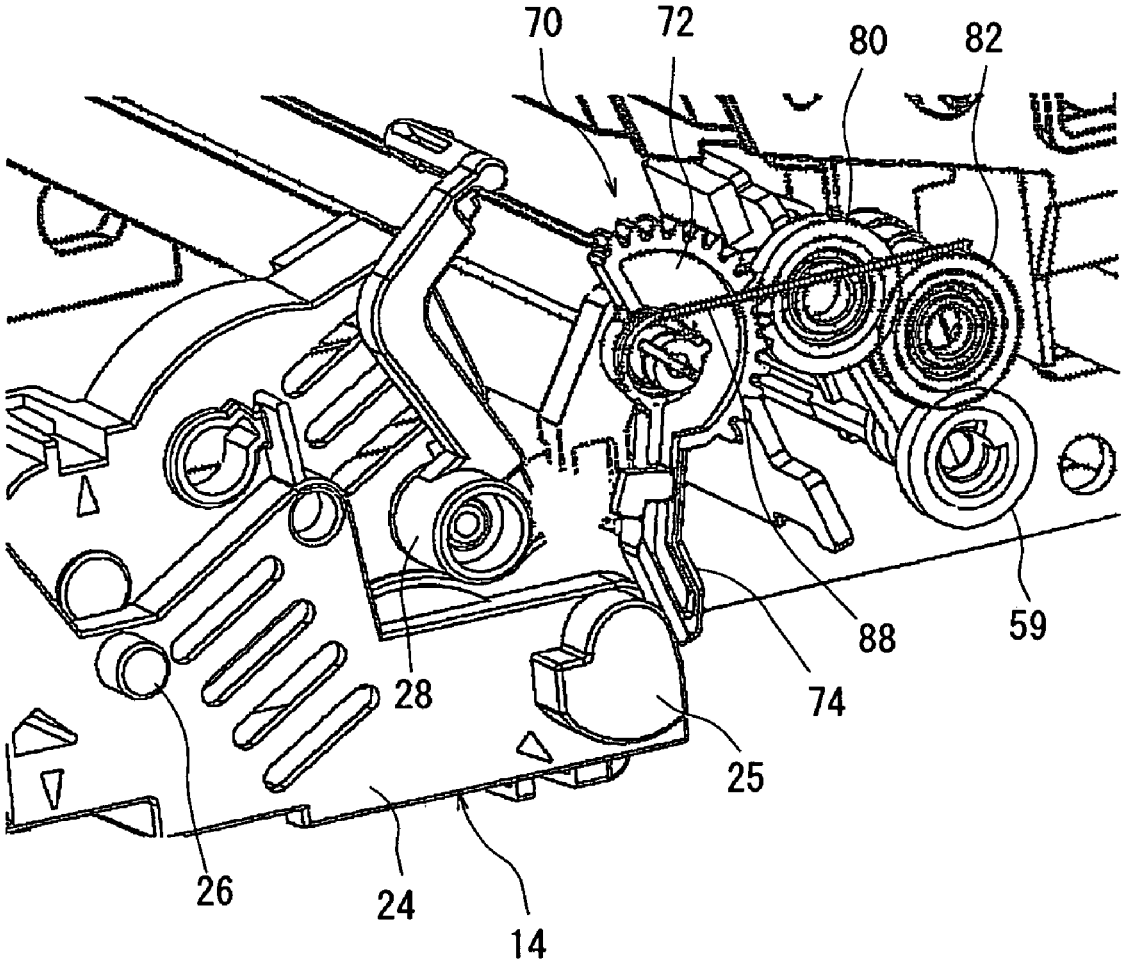
FIG. 12 is a perspective view illustrating a relative positional relationship between the arm member and the developer in the image-forming machine shown in FIG. 2 as viewed from the back side in FIG. 2.
Figure 13:
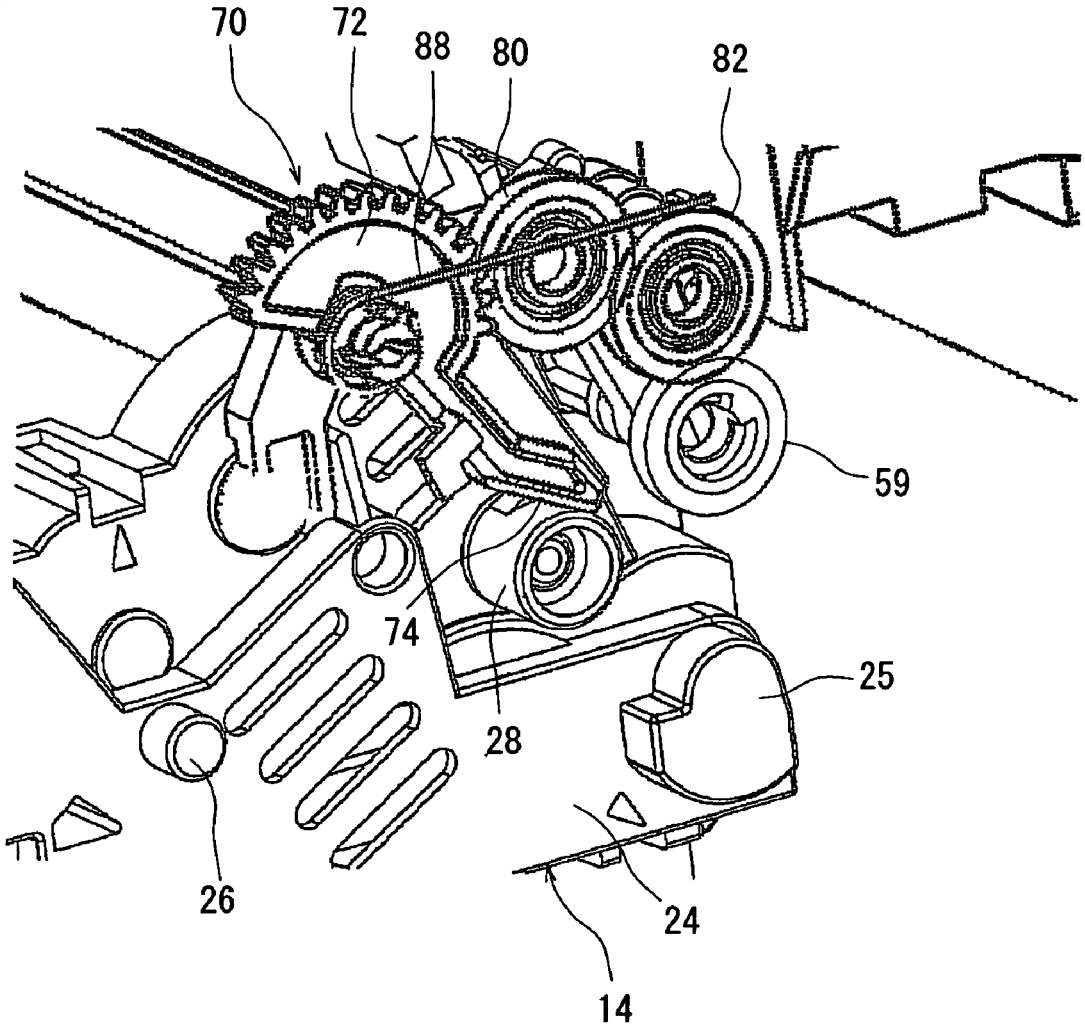
FIG. 13 is a perspective view illustrating a relative positional relationship between the arm member and the developer in the image-forming machine shown in FIG. 3 as viewed from the back side in FIG. 3.

Referring to FIGS. 2, 12 and 13, an arm-operating/to-be-guided member 25, a to-be-guided member 26 and an arm-operating member 28 are disposed so as to protrude outward from the one side wall 24 of the pair of side walls 24 and 24 (only one side wall 24 is shown in FIGS. 2, 12 and 13) maintaining a distance in the direction of width of the housing 20 (in the direction perpendicular to the surface of the paper in FIG. 2). The arm-operating/to-be-guided member 25 is so disposed that the central region thereof is present on an extension of the axis of the developer sleeve that is not shown, and comprises a block of nearly a heart shape in transverse cross section. The to-be-guided member 26 is of the shape of a pin having a circular circumferential surface and is disposed at a position on the right side in FIG. 2 maintaining a distance to the arm-operating/to-be-guided member 25. The arm-operating member 28 is of a cylindrical shape having a circular outer circumferential surface of a diameter larger than that of the to-be-guided member 26, and is disposed at a position on the right upper side in FIG. 2 maintaining a distance to the arm-operating/to-be-guided member 25, which is on the left side maintaining a distance to the to-be-guided member 26 in FIG. 2. The arm-operating member 28 is closer to the arm-operating/to-be-guided member 25 than the to-be-guided member 26 is. The arm-operating/to-be-guided member 25 has a sectional area larger than that of the arm-operating member 28.

The other side wall 24 that is not shown of the housing 20 has a to-be-guided member 25 which is substantially of the same shape as that of the arm-operating/to-be-guided member 25 and a to-be-guided member 26 which is substantially of the same shape as the to-be-guided member 26 at substantially the same positions being opposed to each other and protruding outward (none of which are shown). The developer 14 is detachably mounted on the machine body 4 so as to move in a direction to approach the photosensitive material drum 10 or to separate away therefrom along the guide surfaces 6A and 8A as the arm-operating/to-be-guided member 25 and the to-be-guided member 26 formed on the one side surface 24 are mounted on the guide surface 6A formed on the side wall 6 of the machine body 4 so as to move therealong, and as the to-be-guided member 25 and the to-be-guided member 26, which are not shown, formed on the other side wall 24 are mounted on the guide surface 8A formed on the side wall 8 (FIG. 8) so as to move therealong.

Referring to FIGS. 1, 4 and 5, the machine body 4 has the protection cover 30 that opens and closes a portion of the circumferential surface of the photosensitive material drum 10. The protection cover 30 includes a cover body 32 extending in the lengthwise direction in agreement with the axial direction of the photosensitive material drum 10, first shaft means 34 disposed at an end (right end in FIG. 4) in the lengthwise direction of the cover body 32, and second shaft means 36 disposed at the other end (left end in FIG. 5) in the lengthwise direction of the cover-body 32 on an axis in common with that of the first shaft means 34. The protection cover 30 is supported between the side walls 6 and 8 via the first shaft means 34 and the second shaft means 36 so as to rotate between a closed position (position shown in FIG. 1) and an opened position (position shown in FIGS. 2 and 3). The first shaft means 34 of the protection cover 30 is supported by the one side wall 6 so as to rotate while the second shaft means 36 is supported by the other side wall 8 so as to rotate. A compression coil spring 64 (see also FIG. 10) is provided between the other side wall 8 and the cover body 32 of the protection cover 30 so as to urge the protection cover 30 in the axial direction of the first and second shaft means 34 and 36 toward the one side wall 6.

The protection cover 30 will be described below more concretely. As partly shown in FIGS. 4 to 6, the cover body 32 includes a plate member having a slender and nearly rectangular contour in the lengthwise direction and reinforcing ribs. Referring to FIGS. 4 and 8 to 10, the first shaft means 34 includes a body-end shaft 38 formed integrally with the cover body 32 and is extending in the axial direction from an end of the cover body 32, and a separable driven shaft 40 fitted to the body-end shaft 38, supported by the one side wall 6 so as to turn but being blocked from moving in the axial direction toward the one sidewall 6, and is drive-coupled to an arm member 70 (see FIG. 1) that will be described later.

The second shaft means 36 of the protection cover 30 comprises the other body-end shaft 37 formed integrally with the cover body 32 and is extending in the axial direction from the other end of the cover body 32. The other body-end shaft 37 is supported by the other side wall 8 so as to turn and to move in the axial direction. The constitution of the second shaft means 36 will be described later in detail.

Figure 8:
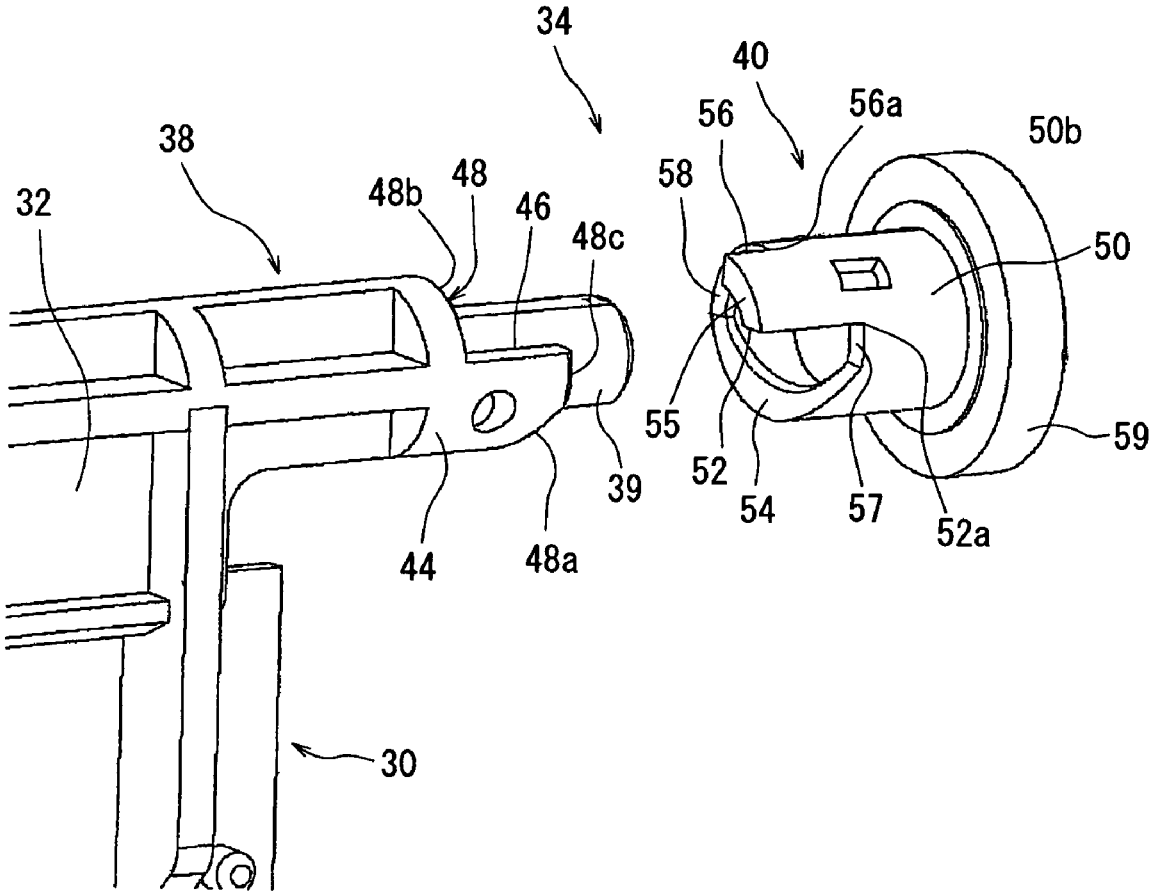
FIG. 8 is a perspective view illustrating, on an enlarged scale, a body-end shaft of the protection cover and a separable driven shaft shown in FIG. 4.
Figure 9:
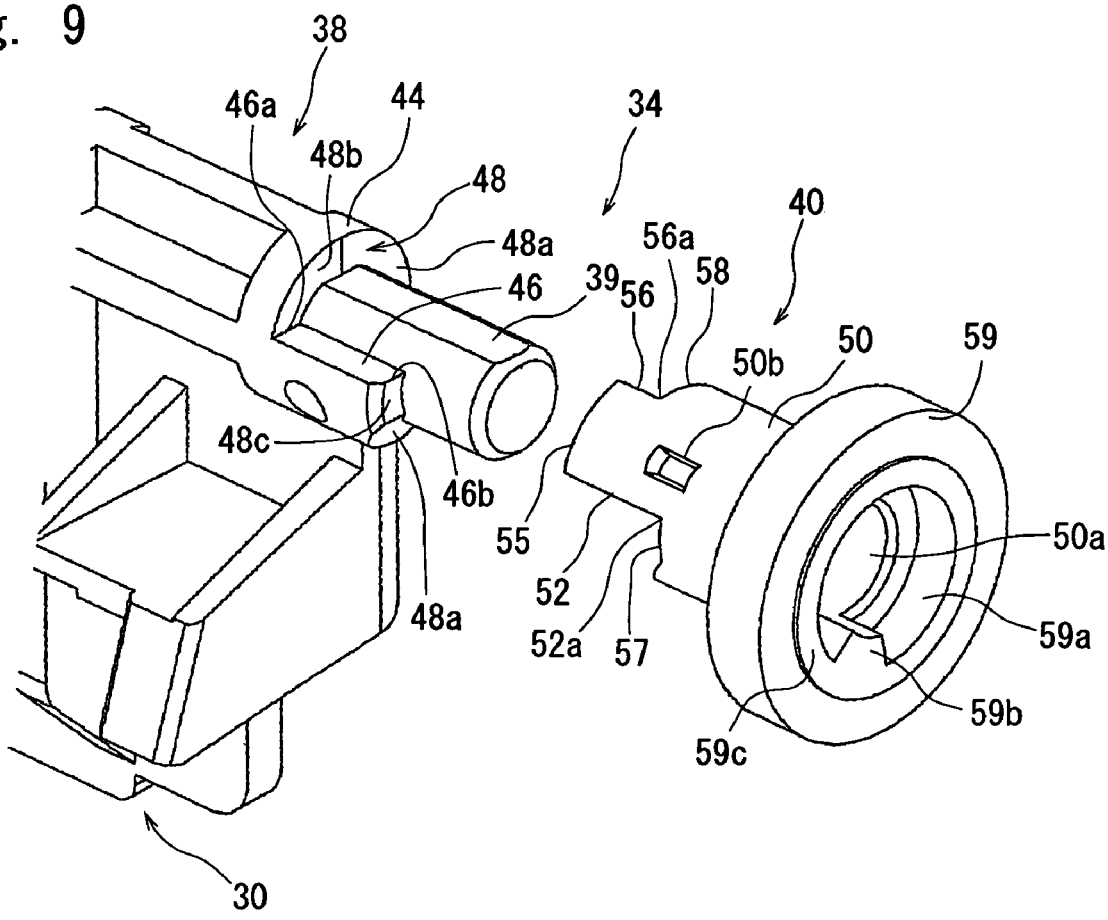
FIG. 9 is a perspective view illustrating, on an enlarged scale, the body-end shaft and the separable driven shaft shown in FIG. 8 as viewed from another angle.

Referring to FIGS. 4, 8 and 9, the one body-end shaft 38 of the first shaft means 34 and the separable driven shaft 40 are provided with first press-contact surfaces 46 and 52 which are brought into press-contact with each other in the circumferential direction to rotate the one body-end shaft 38 integrally therewith when the separable driven shaft 40 is rotated in a direction in which the protection cover 30 closes and are, further, provided with second press-contact surfaces 48*a* and 54 which are brought into press-contact with each other by the spring force of the compression coil spring 64 (FIGS. 5 and 10) in the axial direction to rotate the one body-end shaft 38 integrally therewith when the separable driven shaft 40 is rotated in a direction in which the protection cover 30 openes, and are allowed to move relative to each other in the axial direction.

If further concretely described with reference to FIGS. 8 and 9, a large-diameter portion 44 of a diameter larger than that of an end region 39 (the end region 39 can be said to be a small-diameter portion 39) is provided on the proximal end side (on the side of the cover body 32) of the one body-end shaft 38 except the end region 39. The large-diameter portion 44 includes a first press-contact surface (the one first press-contact surface) 46 comprising a first end surface that extends straight in the axial direction and is facing one of the circumferential directions, and a second end surface 48 that extends from the proximal end 46*a* of the first press-contact surface 46 (proximal end 46*a* on the side of the cover body 32) in the circumferential direction and in the axial direction (axial direction to separate away from the cover body 32) and reaches an end 46*b* of the first press-contact surface 46 (reaches an end in the axial direction on the side opposite to the proximal end 46*a*). The first press-contact surface 46 comprises a rectangular flat surface. The second end surface 48 includes a second press-contact surface (the one second press-contact surfaces) 48*a* comprising a helical surface that helically extends. That is, in this embodiment, the second end surface 48 includes a non-helical surface 48*b* formed in a portion of the region extending in the circumferential direction from the proximal end 46*a* of the first press-contact surface 46, a non-helical surface 48*c* formed in a portion of the region extending in the circumferential direction from the end 46*b* of the first press-contact surface 46, and a second press-contact surface 48*a* of a helical surface formed on a region between the non-helical surface 48*b* and the non-helical surface 48*c*. There can be further proposed another embodiment of forming the entire second end surface 48 by the second press-contact surface 48*a* which comprises the helical surface. Here, however, it is important that at least a portion of the region in the circumferential direction comprises the second press-contact surface 48*a* of the helical surface.

The separable driven shaft 40 includes a cylindrical shaft portion 50 that rotatably fits to the end region 39 of the one body-end shaft 38 and to move in the axial direction. The cylindrical shaft portion 50 includes a first press-contact surface (other first press-contact surface) 52 that is opposed to the first press-contact surface 46 of the one body-end shaft 38 in the circumferential direction, and a second press-contact surface (other second press-contact surface) 54 which is a helical surface opposed to at least a portion of the region of the second press-contact surface 48*a* which is the helical surface of the one body-end shaft 38. In this embodiment, the cylindrical shaft portion 50 includes the first press-contact surface 52, a non-helical surface 55 formed in a portion of the region extending in the circumferential direction from an end of the first press-contact surface 52 (from an end on the side of the one body-end shaft 38), an end surface 56 which linearly extends in the axial direction toward the side opposite to the one body-end shaft 38 from the end on the side opposite to the first press-contact surface 52 in the circumferential direction and faces the other side in the circumferential direction, a non-helical surface 57 formed in a portion of the region extending in the circumferential direction from the proximal end 52*a* of the first press-contact surface 52 (proximal end 52*a* on the side opposite in the axial direction to the end of the one body-end shaft 38), a non-helical surface 58 formed in a portion of the region extending in the circumferential direction from the proximal end 56*a* of the end surface 56 (proximal end 56*a* on the side opposite in the axial direction to the end of the one body-end shaft 38) and a second press-contact surface 54 which is a helical surface extending between the non-helical surfaces 57 and 58. It is important that the cylindrical shaft portion 50 has at least the first press-contact surface 52 that is opposed to the first press-contact surface 46 of the one body-end shaft 38 in the circumferential direction and the second press-contact surface 54 that is opposed to at least a portion of the region of the second press-contact surface 48*a* of the one body-end shaft 38.

A driven gear 59 of a diameter larger than the cylindrical shaft portion 50 is attached to the other end of the cylindrical shaft portion 50 (to the other end on the side opposite in the axial direction to the one body-end shaft 38) of the separable driven shaft 40 so as to rotate integrally therewith. The driven gear 59 has a hole 59*a* of a diameter larger than a through hole 50*a* on an axis common to those of the through hole 50*a* in the cylindrical shaft 50 and of the driven gear 59. A protrusion 59*b* is formed in a portion of the region of the hole 59*a* in the circumferential direction thereof to protrude inward in the radial direction. An end of the protrusion 59*b* is present on an extension of the portion of the region in the circumferential direction on the inner circumferential surface of through hole 50*a* in the cylindrical shaft portion 50.

Figure 10:
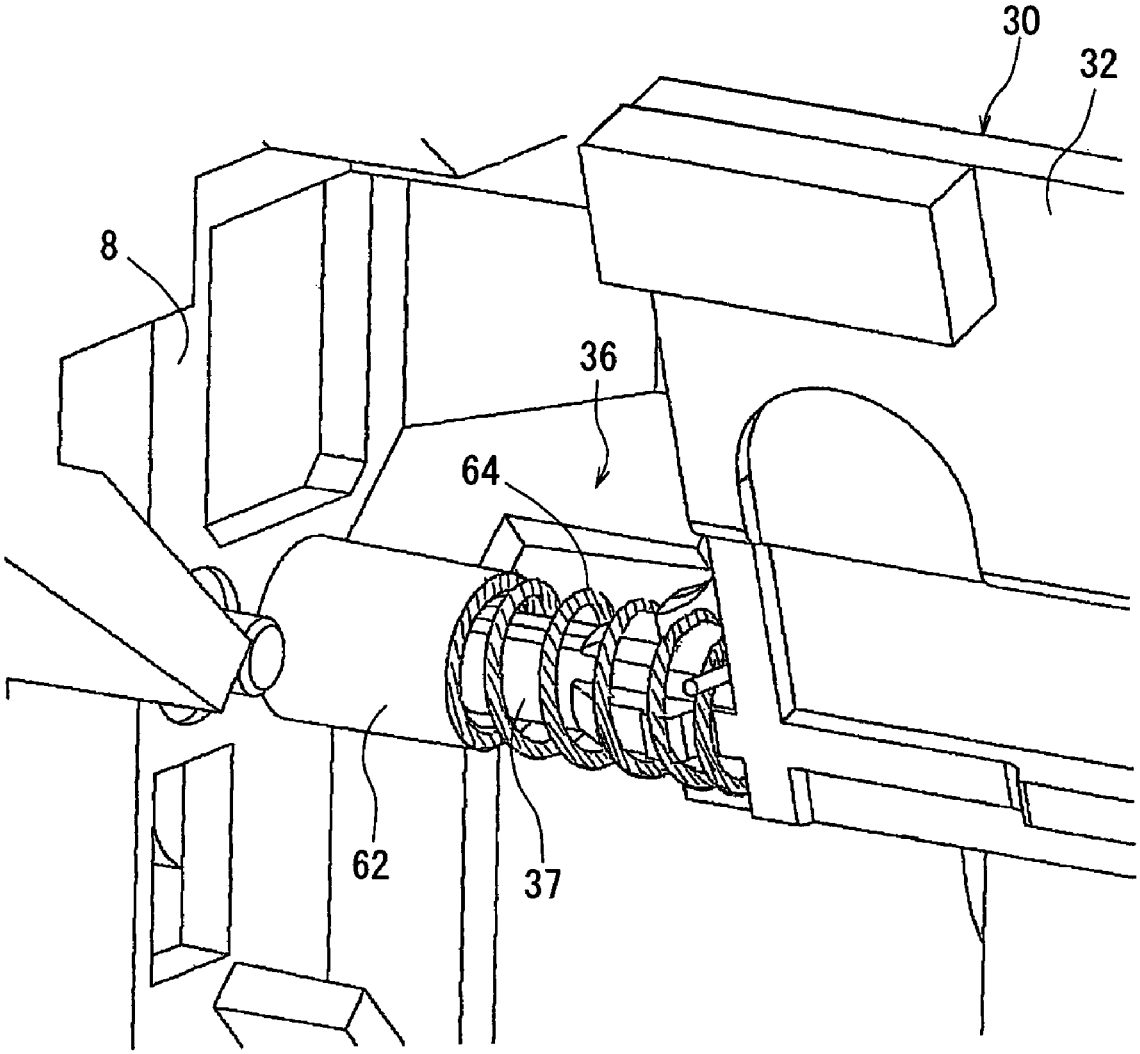
FIG. 10 is a perspective view illustrating, on an enlarged scale, the vicinity of the other body-end shaft of the protection cover shown in FIG. 5.

Referring to FIGS. 5 and 10, the other side wall 8 has a cylindrical bearing 62 formed integrally therewith to extend horizontally and inward. The circular inner circumferential surface of the bearing 62 (bearing surface) has an inner diameter slightly larger than the diameter of the outer circumferential surface of the other body-end shaft 37 of the protection cover 30. The other body-end shaft 37 is fitted to, and supported by, the circular inner peripheral surface of the bearing 62. The compression coil spring 64 is supported wrapping round the other body-end shaft 37, the one end thereof being press-contacted to the other end of the cover body 32 and the other end thereof being press-contacted to the circular end surface of the bearing 62. The other body-end shaft 37 and the one body-end shaft 38 of the cover body 32 are disposed at the regions at the ends in the direction of width thereof at right angles with the lengthwise direction thereof.

Figure 6:
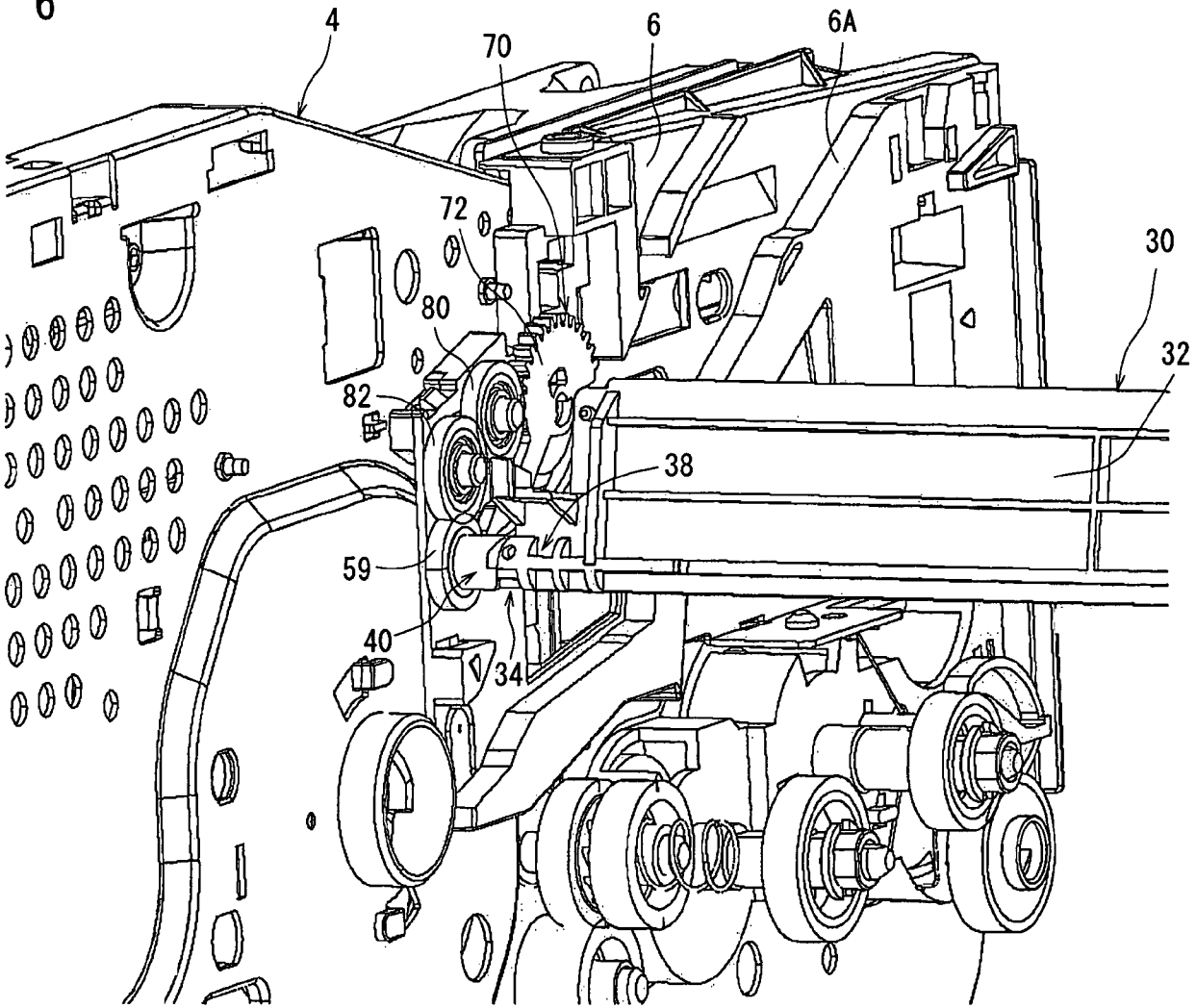
FIG. 6 is a perspective view of the image-forming machine shown in FIG. 2 omitting a portion thereof.
Figure 7:
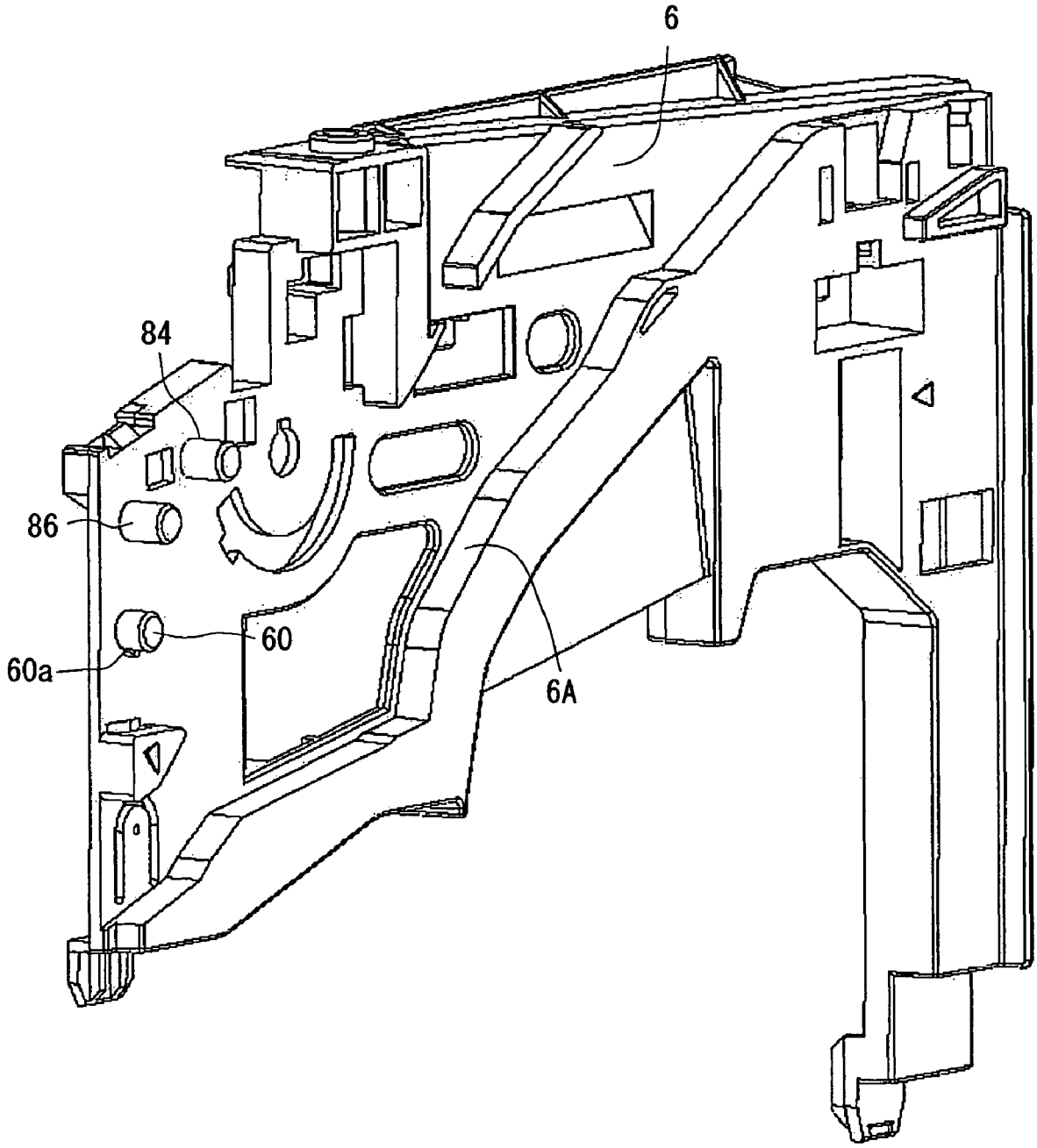
FIG. 7 is a perspective view of a portion of the one side wall of the image-forming machine shown in FIG. 6.

Referring to FIGS. 4 and 6, the separable driven shaft 40 of the protection cover 30 is supported by the one side wall 6 so as to rotate but being blocked from moving in the axial direction toward the one side wall 6. Referring to FIG. 7, the one side wall 6 has a support shaft 60 integrally formed therewith and extending inward and horizontally. The support shaft 60 has a diameter slightly smaller than that of the through hole 50*a* (FIG. 9) of the separable driven shaft 40. A protrusion 60*a* is formed on a portion of the region in the circumferential direction at the proximal end of the support shaft 60 so as to protrude outward in the radial direction. Referring to FIGS. 7 and 9, the through hole 50*a* of the separable driven shaft 40 is rotatably fitted to, and supported by, the end region of the support shaft 60. The protrusion 60*a* of the support shaft 60 is positioned in the hole 59*a* of the driven gear 59 of the separable driven shaft 40. Since the protrusion 59*b* is formed in the hole 59*a*, the range of rotation of the separable driven shaft 40 is from a position at where the protrusion 59*b* of the separable driven shaft 40 comes in contact with the one surface of the protrusion 60*a* of the support shaft 60 in the circumferential direction up to a position at where it comes in contact with the other surface of the protrusion 60*a* in the circumferential direction. The one side surface 59*c* of the driven gear 59 is formed along the peripheral edge of the hole 59*a*, and constitutes an annular surface that slightly extends outward in the axial direction.

Referring to FIGS. 4, 8 and 9, the cylindrical shaft portion 50 of the separable driven shaft 40 is fitted to the end region 39 of the one body-end shaft 38 so as to move in the axial direction. The cover body 32 of the protection cover 30 is urged in the axial direction toward the one side wall 6 due to the spring force in the axial direction of the compression coil spring 64 (FIG. 5). As the one side surface 59*c* (FIG. 9) of the driven gear 59 of the separable driven shaft 40 comes in contact with the inner side surface of the one side wall 6, the protection cover 30 is prevented from moving toward the one side wall 6. Therefore, a portion of the region of the second press-contact surface 48*a* of the one body-end shaft 38 is brought into pressed contact with the second press-contact surface 54 of the separable driven shaft 40. Further, the first press-contact surface 46 of the one body-end shaft 38 is positioned being opposed to the first press-contact surface 52 of the separable driven shaft 40 in the circumferential direction. The non-helical surfaces 48*b* and 48*c* of the one body-end shaft 38 are positioned being opposed to the non-helical surfaces 58 and 57 of the separable driven shaft 40 in the axial direction. A gap is formed between the another portion of the region of the first press-contact surface 48*a* of the one body-end shaft 38 and the end surface 56 and non-helical surface 58 of the separable driven shaft 40. The protection cover 30 is brought to the closed position.

Referring to FIGS. 1 and 4, an arm member 70 is rotatably disposed on the machine body 4 being drive-coupled to the first shaft means 34 of the protection cover 30 so as to open and close the protection cover 30. The arm member 70 includes an arcuate or, in this embodiment, a nearly semi-circular drive gear 72 and an arm 74 that extends outward in the radial direction from an end of the drive gear 72. The central portion of the drive gear 72 is rotatably supported by the support shaft 76 that extends inward and horizontally from the one side wall 6. The main portion of the arm member 70 has a nearly constant thickness in the axial direction. The drive gear 72 of the arm member 70 and the driven gear 59 of the separable driven shaft 40 of the protection cover 30 are drive-coupled together via at least one intermediate gear or, in this embodiment, via two intermediate gears 80 and 82 rotatably supported by the one side wall 6. The intermediate gears 80 and 82 are in mesh with each other. The drive gear 72 of the arm member 70 is in mesh with the intermediate gear 80, and the intermediate gear 82 is in mesh with the driven gear 59 of the separable driven shaft 40. The intermediate gears 80 and 82 are rotatably supported by the support shafts 84 and 86 that extend inward and horizontally from the one side wall 6.

Figure 11:
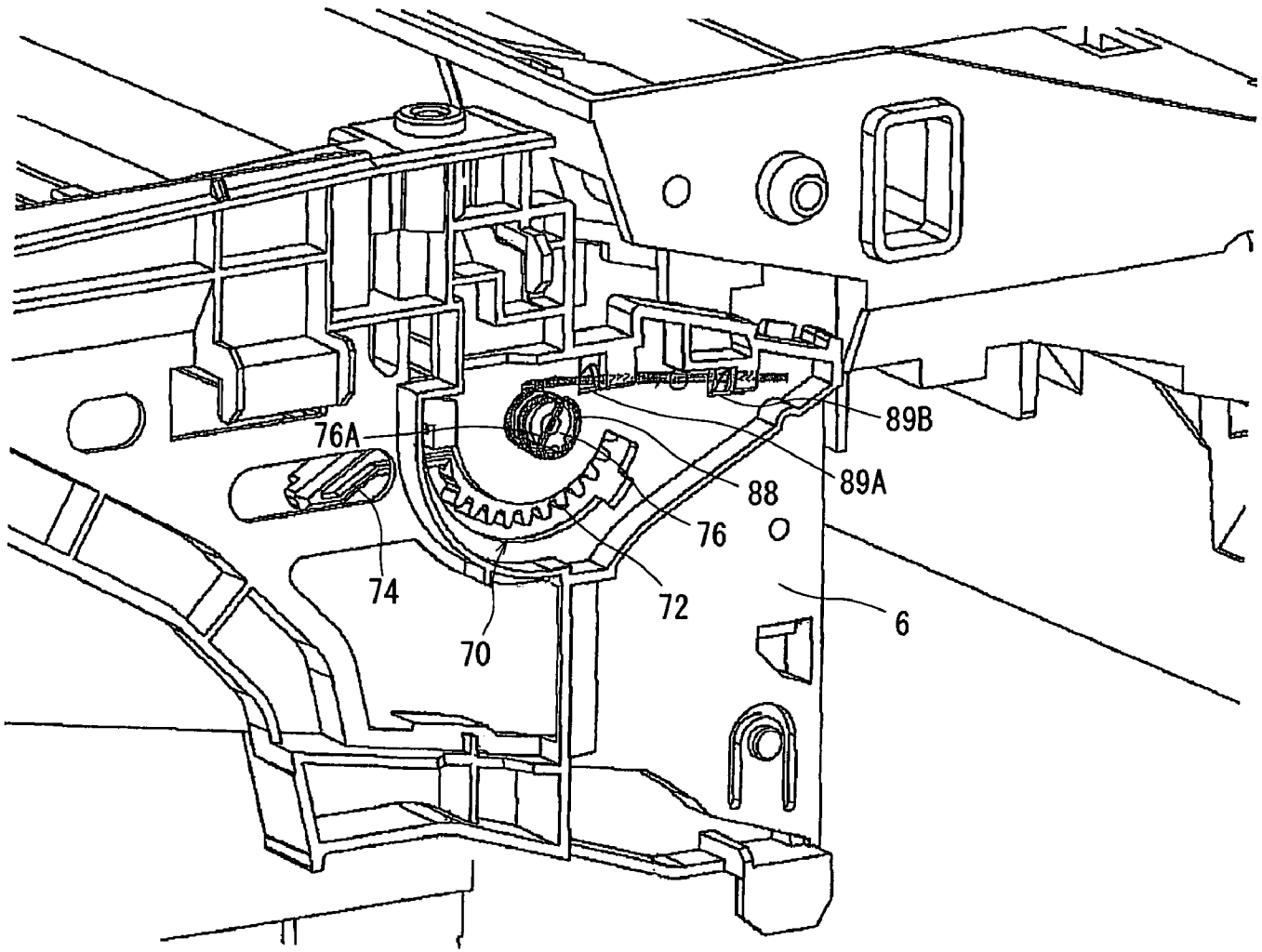
FIG. 11 is a perspective view of the support portion of an arm member in the image-forming machine shown in FIG. 1 as viewed from the back side in FIG. 1.

Referring to FIG. 11, a torsion coil spring 88 which is a first spring means is arranged between the arm member 70 and the one side wall 6 to urge the arm member 70 in the clockwise direction in FIG. 11 (in the counterclockwise direction in FIG. 1) at all times so that the protection cover 30 is turned in the closing direction (clockwise direction in FIGS. 1 to 3). The support shaft 76 of the arm member 70 extends outward of the one side wall 6, the one end of the torsion coil spring 88 engages with an engaging groove 76A formed in an end surface of the support shaft 76, the other end thereof engages with engaging grooves 89A and 89B formed on the outer side of the one side wall 6, and the intermediate portion thereof is wound like a coil on the support shaft 76. Referring to FIG. 1, a stopper 90 which is stop means is provided on the inside of the one side wall 6 to define the position for closing the protection cover 30 by preventing the arm member 70 from turning in the counterclockwise direction in FIG. 1. The stopper 90 is integrally formed to extend inward and horizontally from the one side wall 6. Referring to FIG. 1, as the upper surface of the arm 74 of the arm member 70 is brought into press-contact with the lower surface of the stopper 90 by the torsion coil spring 88, the protection cover 80 is brought to the closed position. In this state, an end (front end) of the arm 74 of the arm member 70 is so positioned as to be present on the locus of motion of the developer 14 (see FIGS. 2 and 3) (more concretely, on the locus of motion of the arm-operating/to-be-guided member 25 and the arm-operating member 28 provided on the one side wall 24 of the housing 20 of the developer 14). The compression coil spring 64 (FIGS. 5 and 10) constitutes second spring means.

Referring to FIG. 1, in a state where the developer 14 is removed from the machine body 4, one end of the arm 74 of the arm member 70 is so positioned as to be present on the locus of motion of the developer 14 (see FIGS. 2 and 3), and the protection cover 30 is brought to the closed position.

Referring to FIGS. 1, 2 and 4, the developer 14 is mounted in the machine body 4 (at a position more on the right side in FIG. 2 than the position shown in FIG. 2 and on the right of the arm member 70) as the arm-operating/to-be-guided member 25 and the to-be-guided member 26 formed on the one side surface 24 of the housing 20 are mounted on the guide surface 6A formed on the side wall 6 of the machine body 4 so as to move therealong, and as the to-be-guided member 25 and the to-be-guided member 26, which are not shown, formed on the other side wall 24 are mounted on the guide surface 8A (see FIG. 5) formed on the side wall 8 so as to move therealong. If the developer 14 is moved in a direction to approach the photosensitive material drum 10 (toward the left in FIG. 2) along the guide surfaces 6A and 8A, the one end of the arm 74 of the arm member 70 is rotated in the clockwise direction in FIGS. 1 and 2 by the arm-operating/to-be-guided member 25 formed on the one side wall 24 of the developer 14. FIG. 12 illustrates a state where the arm-operating/to-be-guided member 25 is brought into contact with the one end of the arm 74. The one end of the arm 74 is rotated by the developer 14 overcoming the spring force of the torsion coil spring 88 (FIG. 11). The rotation of the drive gear 72 of the arm member 70 in the clockwise direction is transmitted to the driven gear 59 of the protection cover 30 via the intermediate gears 80 and 82. The driven gear 59 and the separable driven shaft 40 are rotated in the counterclockwise direction in FIG. 2.

Referring to FIGS. 1, 2, 4 and 5, the one body-end shaft 38 is rotated by the rotation of the separable driven shaft 40 integrally therewith without being substantially moved in the axial direction via the second helical press-contact surfaces 54 and 48*a* that are press-contacted to each other by the spring force of the compression coil spring 64 (FIG. 5). The protection cover 30 is rotated counterclockwise from the closed position shown in FIG. 1. The rotation continues up to the opened position (position shown in FIG. 2) where the cover body 32 of the protection cover 30 comes in contact with the stop wall 18 and is blocked. FIG. 6 partly illustrates a state where the protection cover 30 is brought to the opened position by omitting the developer 14 and the stop wall 18.

The protection cover 30 is rotated from the closed position shown in FIG. 1 to the opened position shown in FIG. 2 and, thereafter, the developer 14 is moved leftward up to the predetermined mounting position in FIG. 2. Then, as shown in FIG. 3, an end of arm 74 of the arm member 70 further rotates counterclockwise up to a position shown in FIG. 3 due to the arm-operating member 28 following the arm-operating/to-be-guided member 25. FIG. 13 illustrates a state where the arm-operating member 28 is brought into contact with the one end of the arm 74. Accompanying the rotation of the arm member 70, the separable driven shaft 40 further rotates in the direction in which the protection cover 30 opens. During this moment, the rotation of the cover body 32 of the protection cover 30 is blocked by the stop wall 18. Therefore, the second press-contact surfaces 48*a* and 54 undergo the sliding relative to each other in the direction of rotation and in the axial direction. The first press-contact surface 46 separates away from the first press-contact surface 52 in the circumferential direction and in the axial direction. As a result, in the state where the protection cover 30 is brought to the opened position, the one body-end shaft 38 moves, i.e., the protection cover 30 moves in the axial direction toward the other side wall 8 without being rotated in the opening direction via the second press-contact surfaces 48*a* and 54 against the spring force of the compression coil spring 64 in the axial direction. The protection cover 30 slides in the axial direction toward the stop wall 18.

According to the above image-forming machine 2 as will be easily understood from the foregoing description, the protection cover 30 rotates to the opened position shown in FIG. 2 and, thereafter, the developer 14 moves leftward up to the predetermined mounting position in FIG. 2. This motion, however, is smoothly absorbed by the sliding action between the second press-contact surfaces 48*a* and 54. In the above embodiment, the predetermined position for mounting the developer 14 is defined as the gap-setting rollers 22 of the developer 14 come in contact with both ends of the surface of the photosensitive material drum 10. The predetermined mounting position is maintained as the developer 14 is urged toward the photosensitive material drum 10 by a spring mechanism 92 (see FIG. 3) arranged inside the side walls 6 and 8.

The developer 14 is removed from the predetermined mounting position shown in FIG. 3 in reverse order to the above mounting operation. While the developer 14 is being moved in the removing direction up to the position shown in FIG. 2 from the predetermined position shown in FIG. 3, the arm member 70 rotates counterclockwise in FIGS. 2 and 3 from the position shown in FIG. 3 up to the position shown in FIG. 3 due to the spring force of the torsion coil spring 88 (FIG. 11). The separable driven shaft 40 is turned clockwise in FIGS. 2 and 3. The one body-end shaft 38 of the protection cover 30 moves in the axial direction toward the one side wall 6 due to the sliding action between the second press-contact surfaces 48*a* and 54 for the separable driven shaft 40 being urged by the spring force of the compression coil spring 64. During this moment, the protection cover 30 moves in the axial direction from the opened position shown in FIG. 3 to the opened position shown in FIG. 2. When the protection cover 30 moves in the axial direction up to the opened position shown in FIG. 2, the first press-contact surface 46 of the one body-end shaft 38 is returned up to a position opposed in the circumferential direction to the first press-contact surface 52 of the separable driven shaft 40.

When the developer 14 is further moved in the removing direction from the position shown in FIG. 2 and is no longer contacted to the arm member 70, the arm member 70 rotates counterclockwise in FIGS. 2 and 1 from the position shown in FIG. 2 to the position shown in FIG. 1 due to the spring force of the torsion coil spring 88 (FIG. 11), and is blocked by the stopper 90 from rotating any more. During this moment, the separable driven shaft 40 further rotates clockwise in FIG. 2. As the first press-contact surface 46 of the one body-end shaft 38 of the protection cover 30 is pushed in the circumferential direction by the first press-contact surface 52 of the separable driven shaft 40, the one body-end shaft 38 rotates, i.e., the protection cover 30 rotates from the position shown in FIG. 2 up to the closed position shown in FIG. 1.

Figure 14:
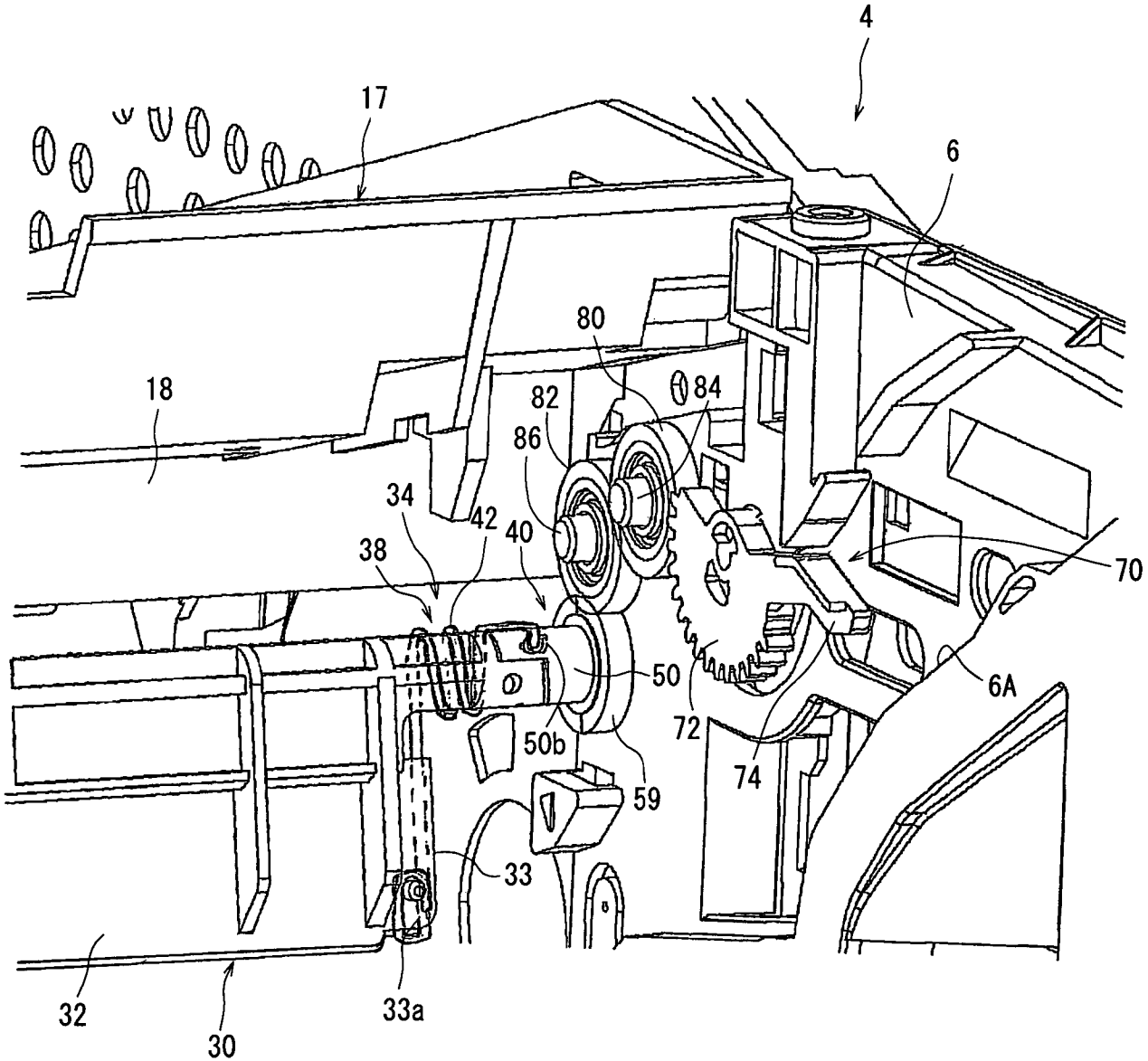
FIG. 14 is a perspective view illustrating a portion of the image-forming machine having second spring means of another embodiment employed by the image-forming machine shown in FIG. 1 (perspective view corresponding to FIG. 4).

The above embodiment uses the compression coil spring 64 (FIGS. 5 and 10) which is the second spring means to push the one body-end shaft 38 of the protection cover 30 onto the separable driven shaft 40 in the axial direction. According to another embodiment, a torsion coil spring 42 is arranged between the one body-end shaft 38 and the separable driven shaft 40 as shown in FIG. 14 instead of the above embodiment. Referring to FIG. 14, one end of the torsion coil spring 42 engages with an engaging hole 50*b* formed in the cylindrical shaft portion 50 of the separable shaft 40. The torsion coil spring 42 extends from the one end thereof, surrounds the large-diameter portion 44 of the one body-end shaft 38 (FIGS. 8 and 9) from a portion where the cylindrical shaft portion 50 of the separable driven shaft 40 is fitted to the end region 39 of the one body-end shaft 38, extends along a stretching portion 33 that is provided to extend along one end of the cover body 32, and the other end portion thereof is engaged with an engaging hole 33*a* formed in the stretching portion 33. Upon thus arranging the torsion coil spring 42, the one body-end shaft 38 can be coupled to the separable driven shaft 40 integrally therewith and can be urged in the axial direction toward the separable driven shaft 40.

According to the image-forming machine 2 of the present invention, the protection cover 30 is supported by the machine body 4 so as to rotate between the closed position and the opened position. The machine body 4 has the arm member 70 that is drive-coupled to the protection cover 30 and rotates to open and close the protection cover 30. The one end of the arm member 70 is so positioned as to be present on the locus of motion of the developer. As the developer 14 moves in a direction to approach the photosensitive material drum 10 along the guide surfaces 6A and 8A which constitute guide means, the one end of the arm member 70 is rotated in one rotational direction by the developer 14, and the protection cover 30 rotates in the opening direction from the closed position up to the opened position. That is, according to the present invention, the machine body 4 is provided with the protection cover 30 and the arm member 70 that is drive-coupled to the protection cover 30 to open and close the protection cover 30. In replacing the developer 14 and/or the drum unit 10U, therefore, there is quite no need of replacing the protection cover 30 and parts related to the protection cover 30 inclusive of the arm member 70 that is drive-coupled to the protection cover 30 to open and close the protection cover 30. This makes it possible to prevent an increase in the cost that stems from the wasteful replacement of parts. This, further, contributes to maintaining the environment since the parts are not wastefully disposed of.

In the above image-forming machine 2, the machine body 4 includes the pair of side walls 6 and 8 arranged maintaining a distance relative to each other. The protection cover 30 includes a cover body 32 that extends in the lengthwise direction which is in agreement with the axial direction of the photosensitive material drum 10, first shaft means 34 disposed at an end of the cover body 32 in the lengthwise direction thereof, and second shaft means 36 disposed at the other end of the cover body 32 in the lengthwise direction thereof on an axis in common with that of the first shaft means 34. The first shaft means 34 of the protection cover 30 is supported by the one side wall 6 so as to rotate, and the second shaft means 36 thereof is supported by the other side wall 8 so as to rotate. The arm member 70 is supported by the one side wall 6 so as to rotate and is drive-coupled to the first shaft means 34 of the protection cover 30. The photosensitive material drum 10 is disposed between the pair of side walls 6 and 8. The stop wall 18 is disposed at a position over the photosensitive material drum 10 between the pair of side walls 6 and 8 to define the opened position of the protection cover 30 by blocking the rotation of the protection cover 30 in the opening direction. This constitution contributes to easily and reliably achieving the above-mentioned effect.

The above image-forming machine 2 includes first spring means which urges the protection cover 30 to rotate in the closing direction at all times, and stop means which brings the protection cover 30 to the closed position by blocking the rotation of the protection cover 30 in the closing direction. The one end of the arm member 70 is rotated in the one rotational direction by the developer 14 against the spring force of the first spring means. The above constitution contributes to stably and reliably opening and closing the protection cover 30 and to rotating the arm member 70 by the developer 14.

In the above image-forming machine 2, the first spring means comprises the torsion coil spring 88 disposed between the arm member 70 and the one side wall 6, and the stop means comprises the stopper 90 disposed on the one side wall 6 so as to block the rotation of the arm member 70 in the other rotational direction. The invention contributes to stably and reliably opening and closing the protection cover 30 and to rotating the arm member 70 by the developer 14 relying upon the simple constitution.

The invention claimed is:

1. An image-forming machine comprising:

a photosensitive material drum rotatably arranged in a machine body;

a developer mounted on the machine body so as to move in a direction to approach, and separate away from the photosensitive material drum along guide means arranged in the machine body;

a protection cover that opens and closes a portion of a peripheral surface of the photosensitive material drum; and an arm member rotatably arranged in the machine body and being drive-coupled to the protection cover to open and close the protection cover, wherein the protection cover is supported by the machine body so as to rotate between a closed position and an opened position, an end of the arm member is so positioned as to be present on a locus of motion of the developer which moves relative to said end of the arm member, and when the developer is moved in a direction to approach the photosensitive material drum along the guide means of the machine body, which moves relative to said end of the arm member, said end of the arm member is rotated by the developer in one rotational direction, and the protection cover rotates in a direction in which it opens from the closed position up to the opened position.

2. The image-forming machine according to claim 1, wherein:

the machine body includes a pair of side walls arranged maintaining a distance relative to each other;

the protection cover includes a cover body extending in the lengthwise direction which is in agreement with the axial direction of the photosensitive material drum, first shaft means disposed at an end of the cover body in the lengthwise direction thereof, and second shaft means disposed at the other end of the cover body in the lengthwise direction thereof on an axis in common with the first shaft means;

the first shaft means of the protection cover is rotatably supported by the one side wall, and the second shaft means is rotatably supported by the other side wall;

the arm member is rotatably supported by the one side wall and is drive-coupled to the first shaft means of the protection cover;

the photosensitive material drum is arranged between the pair of side walls; and a stop wall is arranged at a position over the photosensitive material drum between the pair of side walls to define a position at where the protection cover opens by blocking the rotation of the protection cover in the direction in which it opens.

3. The image-forming machine according to claim 2, wherein:

provision is made for a first spring means for urging the protection cover in the axial direction of the first and second shaft means toward the one side wall;

the first shaft means of the protection cover includes a body-end shaft formed integrally with the cover body and is extending in the axial direction from an end of the cover body, and a separable driven shaft fitted to the one body-end shaft, supported by the one side wall so as to rotate but being blocked from moving in the axial direction toward the one side wall, and is drive-coupled to an arm member;

the second shaft means of the protection cover comprises the other body-end shaft formed integrally with the cover body and is extending in the axial direction from the other end of the cover body, the other body-end shaft being supported by the other side wall so as to rotate and to move in the axial direction;

the one body-end shaft of the first shaft means and the separable driven shaft are, respectively, provided with first press-contact surfaces which are brought into press-contact with each other in the circumferential direction to rotate the one body-end shaft integrally therewith when the separable driven shaft is rotated in a direction in which the protection cover closes and are, further, provided with second press-contact surfaces which are brought into press-contact with each other by the spring force of the second spring means in the axial direction to rotate the one body-end shaft integrally therewith when the separable driven shaft is rotated in a direction in which the protection cover opens, and are allowed to move relative to each other in the axial direction; and the one body-end shaft moves in the axial direction toward the other side wall when the separable driven shaft is rotated in the direction in which the protection cover opens in a state where the protection cover is at the opened position.

4. The image-forming machine according to claim 3, wherein:

the first spring means comprises a compression coil spring disposed between the other side wall and the protection cover.

5. The image-forming machine according to claim 3, wherein:

the one body-end shaft in the first shaft means of the protection cover includes the one first press-contact surface comprising the first end surface extending in the axial direction and facing in one circumferential direction, and a second end surface extending in the circumferential direction and in the axial direction from the proximal end of the one first press-contact surface and arriving at an end of the one first press-contact surface, the second end surface including the one second press-contact surface comprising a helical surface that is helically extending; and the separable driven shaft in the first shaft means of the protection cover includes the other first press-contact surface opposed in the circumferential direction to the one first press-contact surface of the one body-end shaft, and the other second press-contact surface comprising a helical surface opposed to at least a portion of the region of the one second press-contact surface of the one body-end shaft.

6. The image-forming machine according to claim 3, wherein:

a driven gear is attached to the separable driven shaft in the first shaft means of the protection cover so as to rotate integrally therewith, a drive gear is attached to the arm member integrally therewith, and the drive gear of the arm member and the driven gear of the separable driven shaft are drive-coupled together via at least one intermediate gear rotatably supported by the one side surface.

7. The image-forming machine according to claim 1, wherein:

provision is made for a first spring means which urges the protection cover at all times so as to be rotated in a direction in which it closes, and stop means which brings the protection cover to the closed position by blocking the rotation of the protection cover in the direction in which it closes, and said end of the arm member is rotated by the developer in the one rotational direction overcoming the spring force of the first spring means.

8. The image-forming machine according to claim 7, wherein:

the first spring means comprises a torsion coil spring disposed between the arm member and the one side wall, and the stop means comprises a stopper disposed on the one side wall so as to block the rotation of the arm member in the other rotational direction.

* * * * *